US009004879B2

(12) United States Patent
Yang et al.

(10) Patent No.: US 9,004,879 B2
(45) Date of Patent: Apr. 14, 2015

(54) DISCRETE HEAT-INSULATED EXHAUST MUFFLER DEVICE AND REFRIGERATION COMPRESSOR USING SAME

(71) Applicant: Huangshi Dongbei Electrical Appliance Co., Ltd., Huangshi (CN)

(72) Inventors: Baichang Yang, Huangshi (CN); Lijian Cao, Huangshi (CN); Jingxiong Dai, Huangshi (CN); Renshu He, Huangshi (CN); Younan Wang, Huangshi (CN)

(73) Assignee: Huangshi Dongbei Electrical Appliance Co., Ltd., Huangshi (CN)

( * ) Notice: Subject to any disclaimer, the term of this patent is extended or adjusted under 35 U.S.C. 154(b) by 0 days.

(21) Appl. No.: 14/144,209

(22) Filed: Dec. 30, 2013

(65) Prior Publication Data

US 2014/0112804 A1 Apr. 24, 2014

Related U.S. Application Data

(63) Continuation of application No. PCT/CN2012/072579, filed on Mar. 20, 2012.

(30) Foreign Application Priority Data

Sep. 30, 2011 (CN) ..... 2011 1 0297998

(51) Int. Cl.
*F04B 39/10* (2006.01)
*F01N 1/10* (2006.01)
*F04B 39/00* (2006.01)

(52) U.S. Cl.
CPC ..... *F04B 39/0061* (2013.01); *F04B 39/0055* (2013.01); *Y10S 417/902* (2013.01)

(58) Field of Classification Search
CPC ..... F04B 39/0027; F04B 39/0061; F04B 39/0066; F04B 39/0083; F04B 39/023; F04B 39/12; F04B 39/121; F04B 39/123; F04B 39/127; F04B 53/001; F04B 53/16
USPC ..... 417/312, 349, 415, 540, 902, 363; 181/403, 252, 256
See application file for complete search history.

(56) References Cited

U.S. PATENT DOCUMENTS 4,911,619 A * 3/1990 Todescat et al. ..... 417/312
5,340,952 A * 8/1994 Takiguchi ..... 181/282
(Continued)

FOREIGN PATENT DOCUMENTS

CN 1151487 6/1997
CN 101230852 7/2008
(Continued)

*Primary Examiner* — Charles Freay
(74) *Attorney, Agent, or Firm* — Hamre, Schumann, Mueller & Larson, P.C.

(57) ABSTRACT

A discrete, heat-insulating exhaust muffler device (8) and a refrigeration compressor using the exhaust muffler device are provided. The exhaust muffler device (8) includes a metal cavity body defining cavities (9, 10), and intake pipe and exhaust pipe installation holes respectively arranged on the cavities (9, 10). Non-metallic shell bodies (17, 18) are further arranged outside the cavities (9, 10), and the exhaust muffler device (8) is disposed outside cylinder blocks (14) and is separated from the cylinder blocks (14). By disposing a layer of the non-metal shell bodies (17, 18) outside the metal cavity body (9, 10), thermal contact between exhaust gas and gas inside a compressor can be reduced owing to a better heat-insulating effect of the non-metallic material, thereby reducing heat transfer from the metal cavity body (9, 10) to the outside. The gas inside the compressor can have a relatively lower temperature, and the efficiency of the compressor is improved. The metal cavity body (9, 10) are formed by stamping, thereby reducing material cost and the weight of the device, simplifying the manufacturing process, and leaving more room at the periphery of the cylinder blocks (14).

17 Claims, 9 Drawing Sheets

(56) References Cited

U.S. PATENT DOCUMENTS

| | | | | |
|---|---|---|---|---|
| 2004/0170506 | A1* | 9/2004 | Lilie et al. | 417/312 |
| 2009/0155114 | A1* | 6/2009 | Kwan et al. | 418/179 |

FOREIGN PATENT DOCUMENTS

| | | |
|---|---|---|
| CN | 201218127 | 4/2009 |
| CN | 201236781 | 5/2009 |
| CN | 201310397 | 9/2009 |
| CN | 201714630 | 1/2011 |
| CN | 201972764 | 9/2011 |
| CN | 102297118 | 12/2011 |
| CN | 202338461 | 7/2012 |
| JP | 53-131504 | 11/1978 |
| JP | 61-218784 | 9/1986 |
| JP | 2004-225645 | 8/2004 |
| WO | 2006/108767 | 10/2006 |

* cited by examiner

DISCRETE HEAT-INSULATED EXHAUST MUFFLER DEVICE AND REFRIGERATION COMPRESSOR USING SAME

FIELD OF TECHNOLOGY

The present disclosure belongs to the field of hermetically sealed reciprocating refrigeration compressors, in particular, relating to a discrete refrigeration compressor exhaust muffler device and a refrigeration compressor using the same.

BACKGROUND

Technological advancements in refrigeration appliances such as refrigerators have led to rapid progress in the field of refrigeration compressors. With increasing demands for environmental protection and energy conservation, refrigerator manufacturers have increased their efforts in developing energy efficient chlorofluorocarbon (CFC) free refrigerators. Therefore it is necessary for the refrigerator compressor industry to explore new products in order to keep pace with the progress in the refrigerator industry.

Existing refrigerator compressors have a reciprocating piston construction. FIG. 1 shows the structure of a typical refrigeration compressor of a refrigerator. The compressor mainly includes a compressor housing 1, a compressor cylinder block 2, a piston rod 3, a crankshaft 4, an exhaust muffler chamber 5, a compressor cylinder cover 6, a valve plate 7, an intake muffler chamber, an electric motor, and other components. The exhaust muffler chamber 5 is casted onto the compressor cylinder block 2. Compressed gas from the compressor passes through a gas flow passage in the valve plate 7, through the compressor cylinder cover 6, into an exhaust gas flow passage in the compressor cylinder block 2, then is expended and enters the exhaust muffler chamber 5 to reduce the pressure of exhaust gas, and to moderate the high pressure flow of the compressed gas to reduce a noise level from the compressor.

However when the above compressor operates, the temperature and pressure of the compressed gas increases as a result of being compressed (temperature reaching 160° C.±, pressure reaching 32 kg). When the high-temperature-high-pressure gas flows through the exhaust muffler chamber 5, it transfers heat to the exhaust muffler chamber 5. Since the traditional exhaust muffler chamber 5 is casted onto the compressor cylinder block 2, heat is retained at the compressor cylinder block 2, cannot be dissipated outside of the compressor. Due to the heat retained inside the compressor, the compressor cylinder block 2 becomes a heating source. In addition to the heat produced by gas compression, heat is also produced by the electric motor during operation. As a result the temperature inside the compressor can be extremely high, and incoming gas is heated by heating sources inside the compressor. The extremely high temperature of incoming gas lowers the gas density, and thereby reduces the mass of incoming gas and the amount of compressed gas produced by the compressor. This leads to a reduction in the mass of output refrigerant. Thus, the compressor may consume a large amount of energy but deliver poor cooling performance.

FIG. 2 illustrates another exhaust muffler device for an existing refrigeration compressor. The exhaust muffler device includes an ellipsoidal exhaust buffer chamber 11. The exhaust buffer chamber 11 is located outside the compressor cylinder block and is connected to the compressor cylinder block via a pipe. The exhaust buffer chamber 11 is formed by rotating and extruding a copper pipe and the manufacturing process is complicated. The resulting exhaust buffer chamber is heavy and expensive to produce. In addition, copper conducts heat rapidly, and further reduces compressor cooling efficiency when coupled with the high temperature inside the compressor.

SUMMARY

An object of the present disclosure is to overcome aforementioned shortcomings of traditional compressors by providing a discrete heat-insulated exhaust muffler device and a refrigeration compressor using the exhaust muffler device. The exhaust muffler device is capable of effectively reducing compressor noise levels and reducing negative effects of hot gas inside the compressor. The exhaust muffler device can significantly improve compressor cooling performance and is suitable for use in a hermetically sealed refrigeration compressor, particularly a small-sized hermetically sealed refrigeration compressor.

A further object of the present disclosure is to provide a discrete exhaust muffler device that is low cost, light weight, structurally simple, and easily manufactured, and a refrigeration compressor using the exhaust muffler device, particularly a small-sized hermetically sealed refrigeration compressor.

According to one embodiment of this disclosure, a discrete, heat-insulating exhaust muffler device for a refrigeration compressor includes a metal cavity body defining a cavity, installation holes on the metal cavity body configured to respectively connect a gas intake pipe and an exhaust pipe to the cavity. A non-metallic shell is disposed on an outside of the metal cavity body. The non-metallic shell has installation holes associated with the respective installation holes on the metal cavity body for connecting the gas intake pipe and the exhaust pipe.

According to the above embodiment, the non-metallic shell can be separately formed and subsequently mounted outside the metal cavity. The non-metallic shell can be casted with the metal cavity body to form a single body. The non-metallic shell can be chemically deposited on the outer surface of the metal cavity by electroplating, electrophoresis, or other methods.

According to the above embodiment, the non-metallic shell includes raised projections disposed on an interior wall of the non-metallic shell.

According to the above embodiment, the non-metallic shell is made of a non-metallic heat-insulating material that is intermiscible with refrigerant or engine oil for the refrigeration compressor. The non-metallic heat-insulating material includes a plastic or a rubber.

According to the above embodiment, the non-metallic shell includes first and second shell bodies that are configured to be joined together. Each of the shell bodies is separately formed and subsequently joined together to form the non-metallic shell that is to be mounted on the outside of the metal cavity body.

According to the above embodiment, the first and second shell bodies of the non-metallic shell are joined together by snap-fitting, adhesive bonding, or heat bonding when mounted on the outside of the metal cavity body.

According to the above embodiment, the raised projections are provided on an interior wall of a major surface of each of the first and second shell bodies.

According to the above embodiment, the first shell body of the non-metallic shell has a level bottom and vertical side walls extending perpendicularly from a periphery of the level bottom. The side walls have an equal height. The second shell body has a slanted bottom and side walls extending from a periphery of the slanted bottom, the side walls extend in parallel to each other toward ends in flush with each other that mate with the sidewalls of the first shell body.

According to the above embodiment, the first shell body has protrusions on the vertical side walls along two long sides thereof, and the second shell body has snap-fitting rings on the side walls along two long sides thereof. Alternatively, the first shell body has the snap-fitting rings and the second shell body has the protrusions. The snap-fitting rings and the protrusions are configured to snap-fitted with each other.

According to the above embodiment, the case is made from a PBT engineering plastic.

According to the above embodiment, the non-metallic shell has a thickness of 0.5 mm-2.5 mm. Raised projections are provided on an interior wall of the non-metallic shell. The raised projections are projected from the interior wall to a distance of 0.2 mm to 1 mm.

According to the above embodiment, the metal cavity body is formed by welding together first and second cavity bodies to define the cavity.

According to the above embodiment, each of the two cavity bodies is formed by stamping a steel plate or a metal alloy plate.

According to the above embodiment, a baffle is mounted inside the metal cavity body between the first and second cavity bodies. The baffle has a gas flow buffer hole and an exhaust pipe installation hole. The gas flow buffer hole has a diameter smaller than that of the exhaust pipe installation hole.

According to the above embodiment, the baffle is mounted vertically or horizontally inside the metal cavity body between the first and second cavity bodies.

According to the above embodiment, the metal cavity body has a rectangular shape, and the non-metallic shell has a shape matching that of the metal cavity body.

According to the above embodiment, the exhaust muffler device is located outside of a compressor cylinder block of the refrigeration compressor, and is separated from the compressor cylinder block.

The present disclosure provides a hermetically sealed refrigeration compressor using the exhaust muffler device described above, major components inside the sealed compressor housing include a compressor cylinder block, a crankshaft piston connecting rod assembly, a valve assembly, an intake muffler chamber assembly, an electric motor, and an exhaust muffler device. The electric motor is located on a bottom inside the compressor housing. The compressor cylinder block is located above the electric motor. The crankshaft piston connecting rod assembly connects to the valve assembly through the compressor cylinder block. The compressor cylinder cover is located at an end of the valve assembly. The intake muffler chamber assembly and the valve assembly are disposed adjacent with each other inside the compressor housing. The exhaust muffler device is located outside the compressor cylinder block and is separated from the compressor cylinder block. The non-metallic shell is mounted at an outside of the metal cavity body of the exhaust muffler device.

According to the above embodiment, a gas intake pipe extends through a gas intake pipe installation hole on the exhaust muffler device. The gas intake pipe connects to the compressor cylinder cover via a gas intake connection pipe, an exhaust pipe extends through an exhaust pipe installation hole on the exhaust muffler device, and the exhaust pipe is in fluid communication with the outside of the compressor housing via an internal high pressure exhaust pipe.

According to the above embodiment, the exhaust muffler device is mounted vertically or horizontally inside the compressor housing.

According to the above embodiment, inside the compressor housing, the gas intake connection pipe between the gas intake pipe of the exhaust muffler device and the compressor cylinder cover is horizontally disposed. A first end of the gas intake connection pipe connects to the gas intake pipe of the exhaust muffler chamber. A second end of the gas intake connection pipe is welded to an annular exhaust connection ring on the compressor cylinder cover. A circular gas flow passage in the center of the annular exhaust connection ring is in fluid communication with a gas flow passage of the gas intake connection pipe. The circular gas flow passage allows gas to flow therethrough after installation of a compressor cylinder cover screw thereon. The circular gas flow passage in the annular exhaust connection ring is in fluid communication with a gas flow passage of the compressor cylinder cover.

Compared to existing technologies, the embodiments described herein have the following advantages:

1. A non-metallic shell is mounted on the outside of a metal cavity body of an exhaust muffler device. The non-metallic shell is made of a non-metallic material that possesses superior heat insulating properties and can reduce thermal contact between exhaust gas inside the exhaust muffler device and gas inside the compressor. The non-metallic material can also reduce outward heat transfer from the metal cavity body of the exhaust muffler device. As a result, the temperature inside the compressor can be reduced and the efficiency of the compressor can be improved.

2. Raised projections are provided on an interior wall of the non-metallic shell that can prevent thermal contact between the metal cavity body and the non-metallic shell and reduce heat transfer from the metal cavity body to the non-metallic shell. As a result, heat transfer from hot compressed gas produced by the compressor cylinder to refrigerant inside the compressor housing is reduced. Therefore the temperature inside the compressor can be reduced and the efficiency of the compressor can be improved.

3. Placing the exhaust muffler device outside the compressor cylinder block can greatly reduce heat transfer therebetween during operation of the compressor and can dramatically improve the efficiency of the compressor.

4. The metal cavity body of the exhaust muffler device can be formed by stamping and subsequent welding of a thin metal sheet. The non-metallic material of the shell can have a light weight. Therefore the cost and weight of the device can be significantly reduced. The manufacturing process can be simplified, and more space can be made available around the compressor cylinder block.

DETAILED DESCRIPTION

Figure 1:
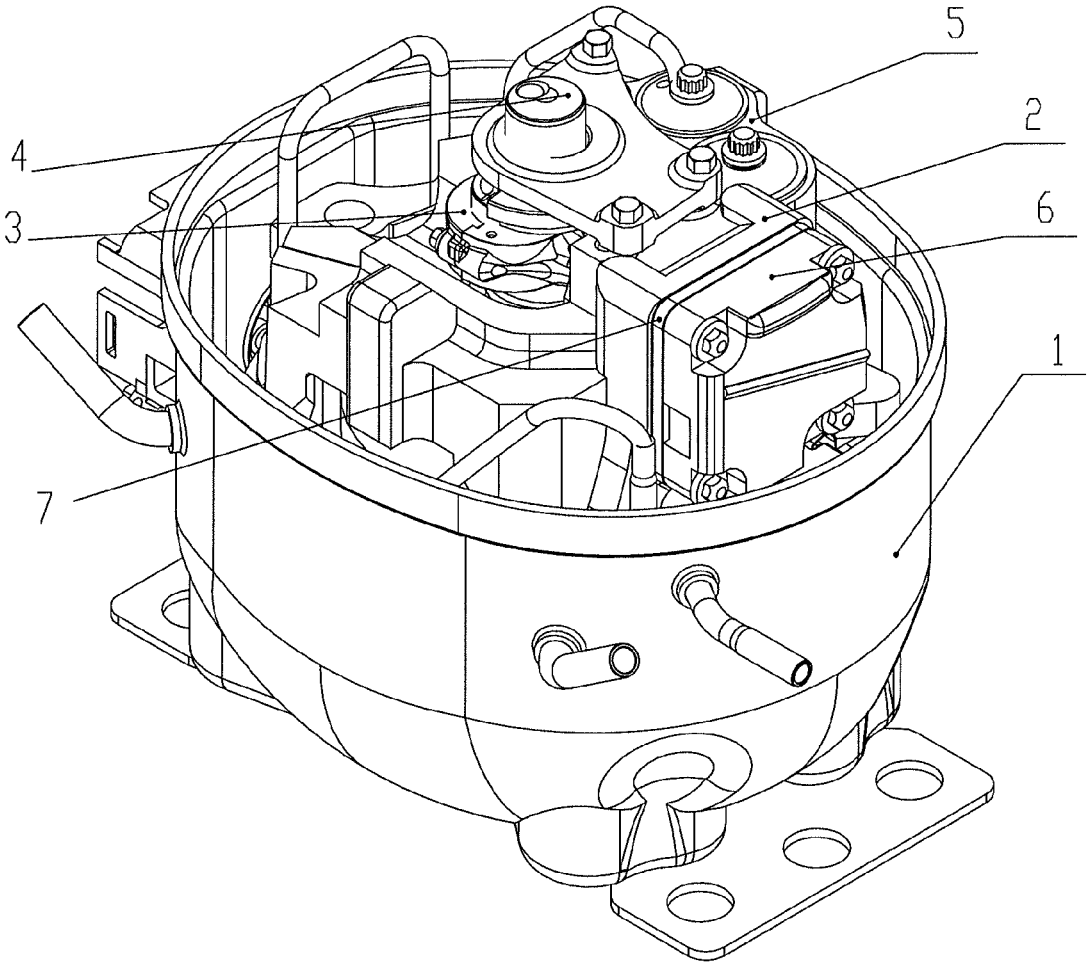
Figure 1 (Prior art)
FIG. 1 is an illustration of a traditional exhaust muffler device of a compressor.
Figure 2:
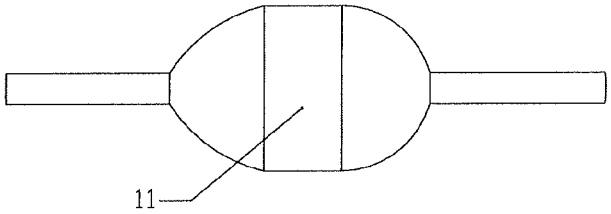
Figure 2 (Prior art)
FIG. 2 is an illustration of a traditional discrete exhaust muffler device.
Figure 3:
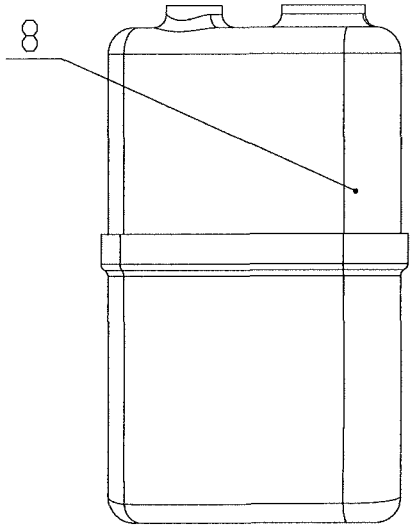
FIG. 3 is an illustration of a metal cavity body of an exhaust muffler device, according to one embodiment.
Figure 4:
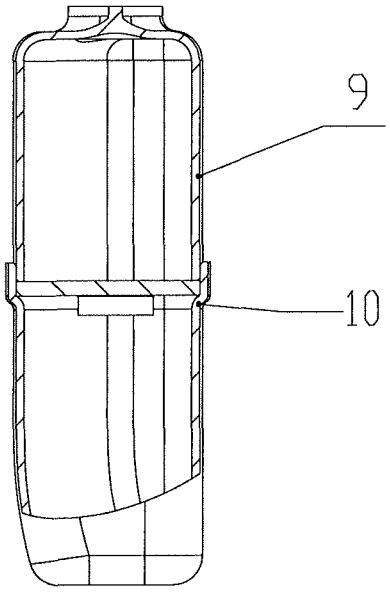
FIG. 4 is a left side perspective view of the exhaust muffler device of FIG. 3.
Figure 5:
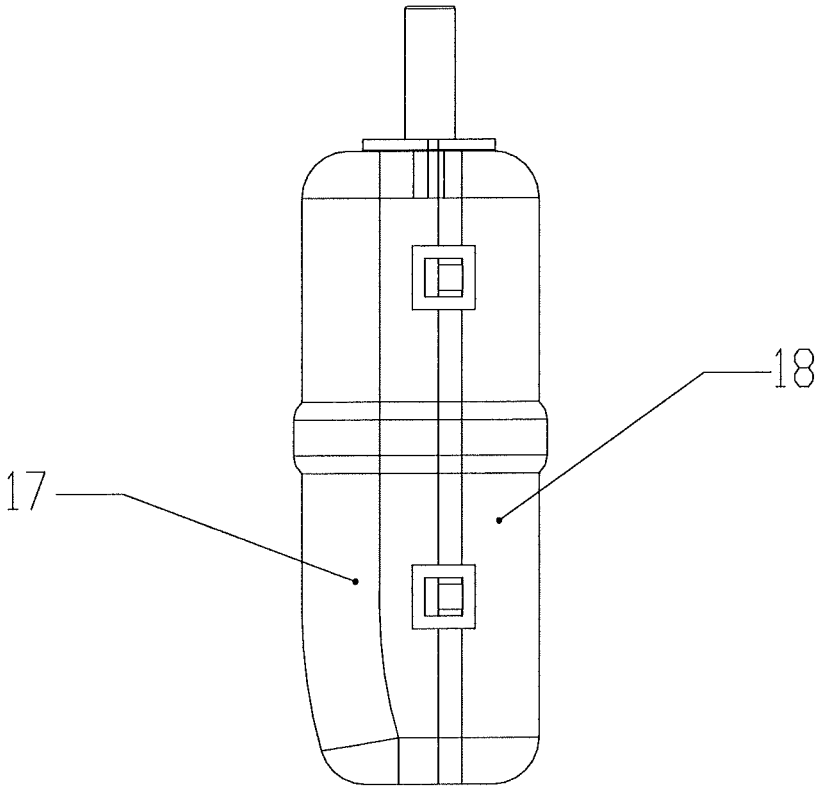
FIG. 5 is an illustration of a non-metallic shell, according to one embodiment.

The following, in conjunction with the examples in FIGS. 1-17, provides a detailed description of the embodiments which are to be considered in all respects as illustrative and not limiting.

As shown in FIGS. 3-4 and 5-14, an exhaust muffler device 8 is disposed on an outside of a compressor cylinder block 14. The exhaust muffler device 8 includes an upper cavity body 9 and a lower cavity body 10 each defining a cavity thereof. Each of the cavity bodies 9 and 10 can be formed by stamping a piece of metal. Then the cavity bodies 8 and 9 are mated and joined together. The upper cavity body 9 and the lower cavity body 10 can be welded together to form a metal cavity body. The shape of the metal cavity body can be rectangular or other regular shapes such as, for example, ellipsoidal, spherical, cubical, etc. A shell 12 made of a non-metallic material is mounted on the outside of the metal cavity body. In one embodiment, the shell 12 can be separately formed by, for example, injection molding. In another embodiment, the shell 12 can be formed by injection-molding together with the metal cavity body. In another embodiment, the shell 12 can be formed by depositing a non-metallic material onto the outer surface of the metal cavity body through a chemical process such as, for example, electroplating. The non-metallic material can be a non-metallic heat-insulating material that is intermiscible with refrigerant or engine oil for a refrigeration compressor. The non-metallic heat-insulating material can include, for example, a plastic, or a rubber. A preferred non-metallic material is polybutylene terephthalate (PBT) engineering plastic or other non-metallic material(s) suitable for use with a refrigeration compressor.

Preferably, raised projections 25 are provided on an interior wall of the non-metallic shell 12 to prevent the shell 12 from contacting the metal cavity body. The surface area covered by the raised projections 25 can vary as long as the contact between the shell 12 and the metal cavity body is prevented. Further, the non-metallic shell 12 of the exhaust muffler device 8 has a wall thickness of 0.5 mm to 2.5 mm, and the raised projections 25 are projected from a surface of the interior wall of the shell 12 to a distance of 0.2 mm to 1 mm.

As shown in FIGS. 5-12, the non-metallic shell 12 is mounted on the outside of the metal cavity body of the exhaust muffler device 8. The non-metallic shell 12 can be formed by injection molding. The shell 12 includes shell bodies 17 and 18. The shell bodies 17 and 18 can be joined together by, for example, snap-fitting, adhesive bonding, or heating bonding, and be mounted on the outside of the metal cavity body. FIGS. 5-12 illustrate an example of a non-metallic shell formed by snap-fitting. The shell bodies 17 and 18 are joined together by engaging a snap-fitting ring on a side wall of one shell with a corresponding protrusion on a side wall of the other shell. FIGS. 8-9 and 10-11 respectively illustrate two embodiments of the shell body 17 that respectively have a protrusion and a snap-fitting ring. The shell body 17 of FIG. 9 can be mated with the shell body 18 of FIG. 12.

In the above embodiments, the raised projections 25 are located on the interior walls of the shell bodies 17 and 18 of the non-metallic shell 12 to prevent a thermal contact between the shell 12 and the metal cavity body. The amount of surface area covered by the raised projections 25 can vary as long as the thermal contact between the shell 12 and the metal cavity body can be prevented. In one embodiment, the raised projections 25 extend along a long edge of a rectangle and form spaced rows on an interior wall of a major cover surface of the shell bodies 17 and 18. The raised projections 25 may also be located on a side wall of the major cover surface of the shell bodies 17 and 18.

Figure 6:
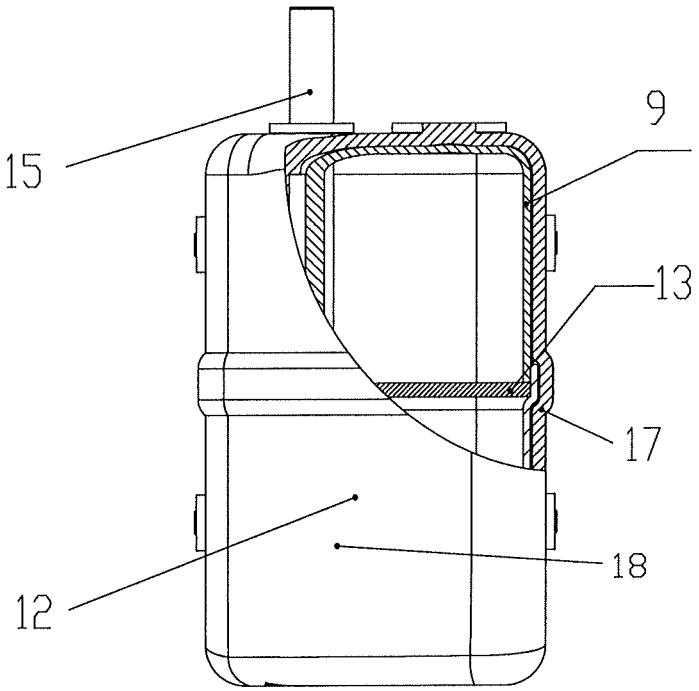
FIG. 6 is a left side perspective view of the non-metallic shell of FIG. 5.
Figure 7:
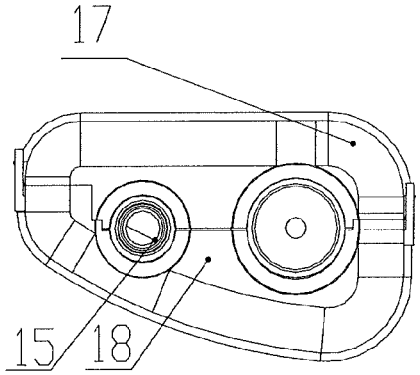
FIG. 7 is a top perspective view of the non-metallic shell of FIG. 5.
Figure 8:
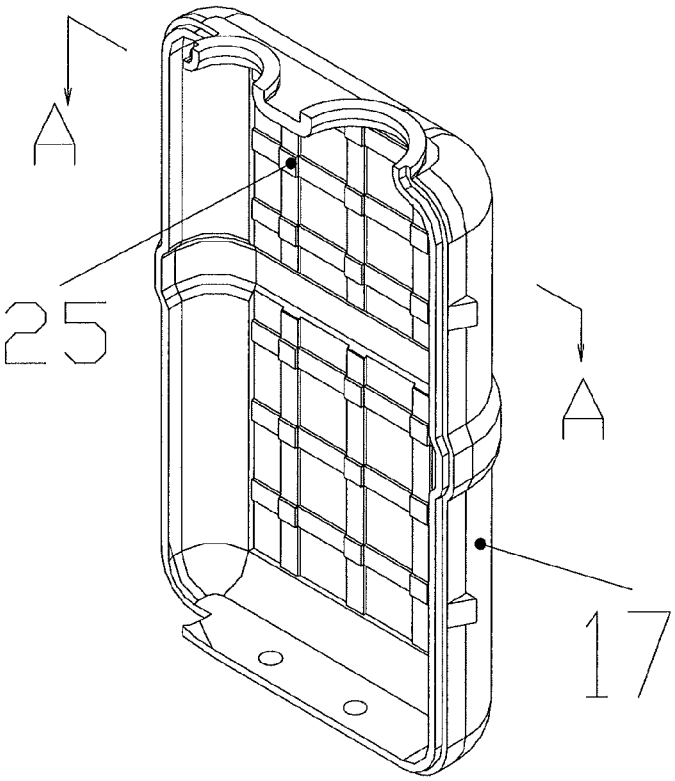
FIG. 8 is a three-dimensional view of a shell body of a non-metallic shell with raised projections, according to one embodiment.
Figure 9:
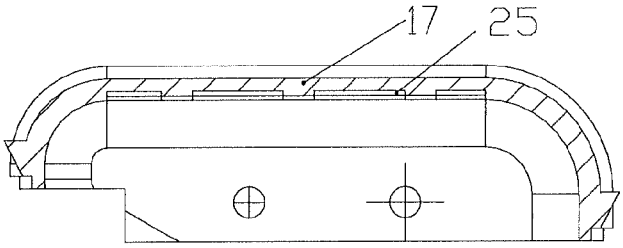
FIG. 9 is cross-sectional view along the A-A axis of FIG. 8.
Figure 10:
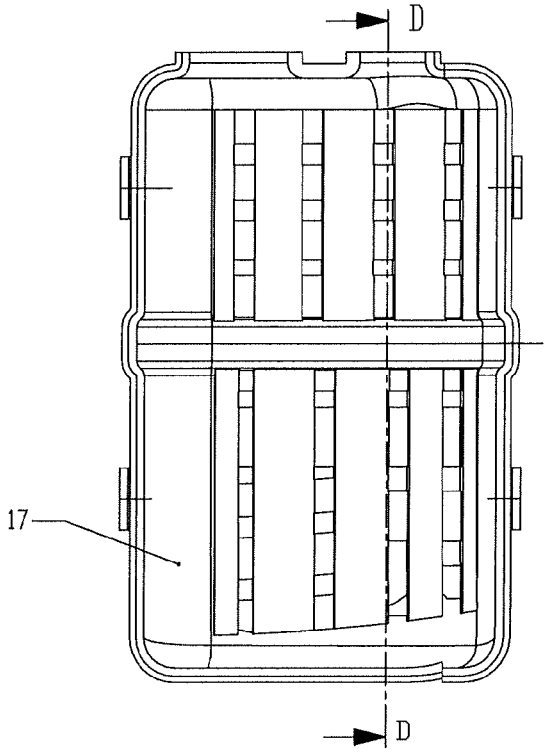
FIG. 10 is a front perspective view of a shell body of a non-metallic shell with snap-fitting rings that is a variant of the embodiment of FIG. 8, according to another embodiment.
Figure 11:
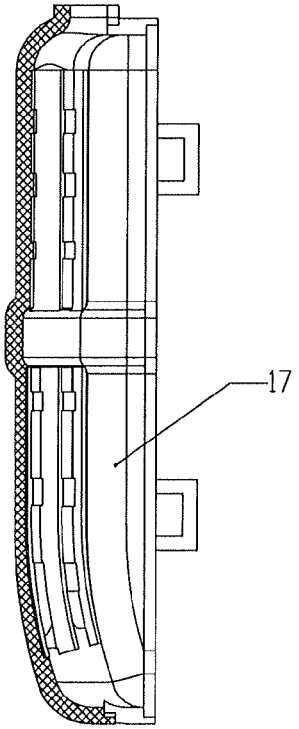
FIG. 11 is a cross-sectional view along the D-D axis of FIG. 10.
Figure 12:
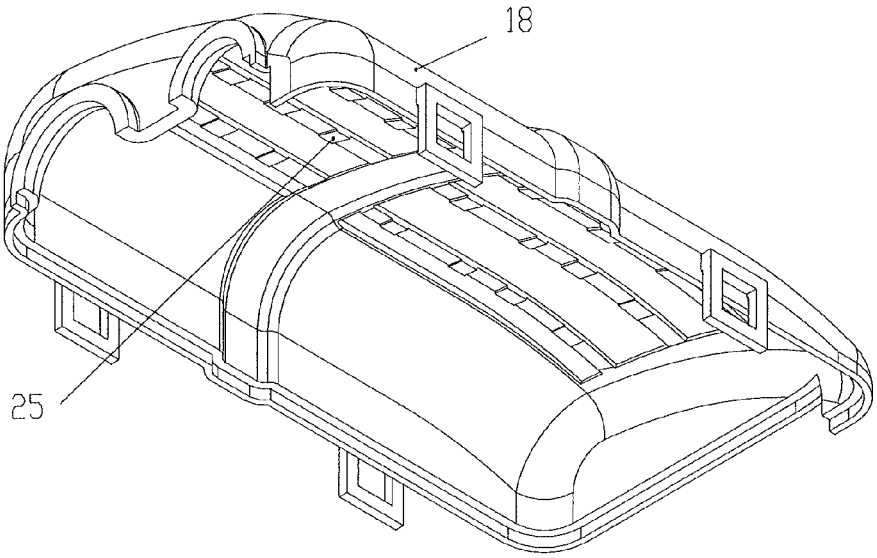
FIG. 12 is a three-dimensional view of a shell body of a non-metallic shell with snap-fitting rings to be joined with the shell body of the non-metallic shell shown in FIG. 8.
Figure 13:
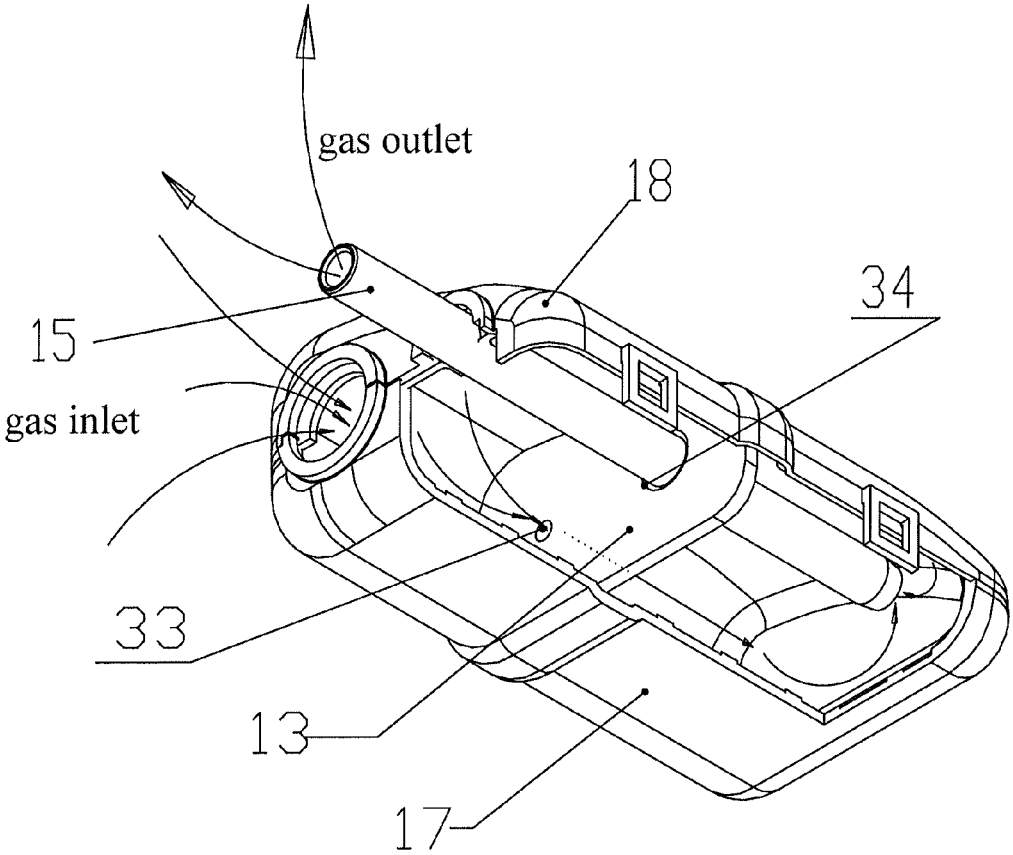
FIG. 13 is a three-dimensional view of the internal structures of an exhaust muffler device according to one embodiment.

As shown in FIGS. 3-5 and 13, the metal cavity body of the exhaust muffler device 8 is formed by stamping and subsequent welding of a metal material. A preferred metal material is 08AL or other relatively thin metal sheets or metal alloys suitable for deep-stamping. A baffle 13 is mounted transversely inside the metal cavity body between the upper cavity 9 and the lower cavity 10 (FIGS. 6 and 13). In another embodiment, the baffle 13 can be mounted vertically inside the metal cavity body between the upper cavity body 9 and the lower cavity body 10 (not shown), as long as the baffle 13 can partition the cavity defined by the metal cavity body. It is to be understood that the baffle 13 may not be required in situations where the compressor as a whole is relatively quiet during operation. The baffle 13 may have two small holes 33 and 34 as shown in FIG. 13. One is a gas flow buffer hole 33, and the other is an exhaust pipe installation hole 34. The diameter of the gas flow buffer hole 33 is smaller than the diameter of the exhaust pipe installation hole 34. High-temperature-high-pressure gas from a compressor cylinder enters the inside of the upper cavity body 9 of the metal cavity body via a gas intake pipe (not shown). The gas intake pipe is connected to the upper cavity body 9 through a gas intake pipe installation hole thereof. The intake gas is decompressed and enters the inside of the lower cavity body 10 through the gas flow buffer hole 33 on the baffle 13. The gas is further decompressed inside the lower cavity body 10, flows upward through an exhaust pipe 15 mounted in the exhaust pipe installation hole 34 of the baffle 13, through other pipes inside a compressor housing 26 to be discussed further below, and flows out of the compressor.

The gas flow buffer hole 33 of the baffle 13 has a diameter of 2.0 mm to 4.0 mm. The exhaust pipe installation hole 34 of the baffle 13 has a diameter of 3.0 mm to 7.0 mm.

Figure 14:
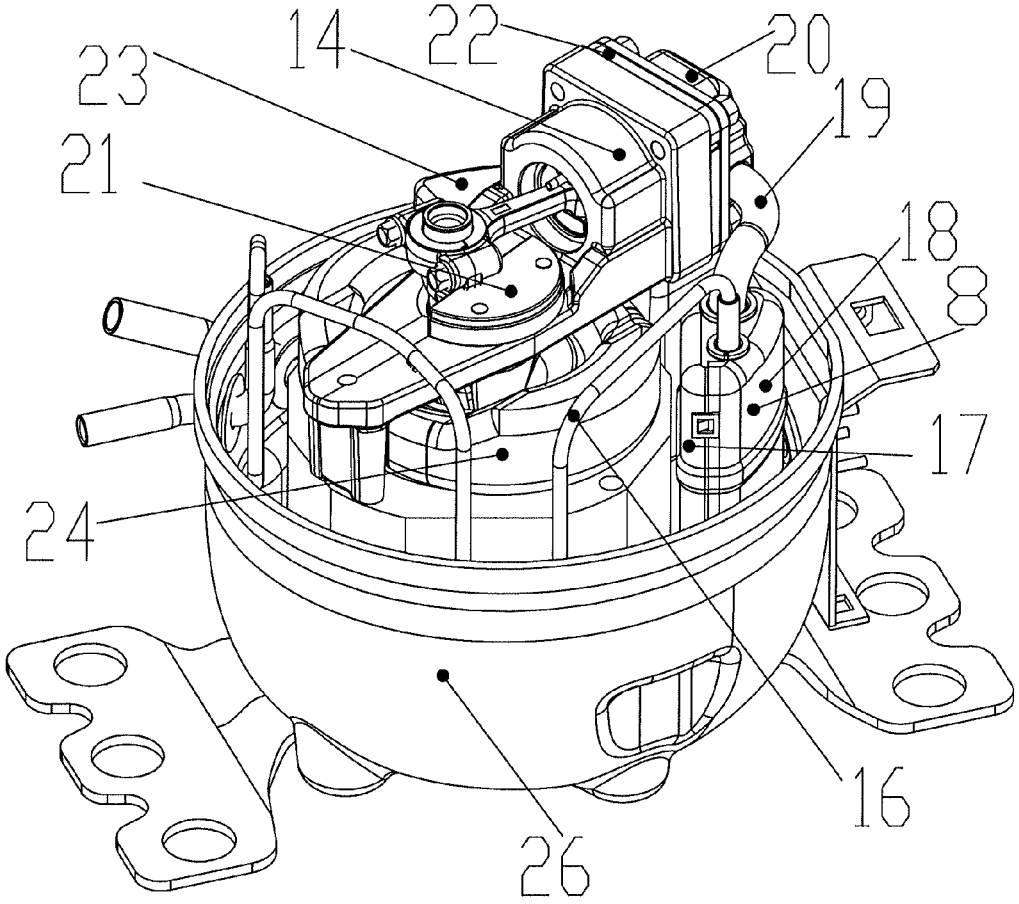
FIG. 14 is an illustration of an exhaust muffler device placed inside a compressor housing according to one embodiment.

As shown in FIGS. 13 and 14, the compressor housing 26 is a hermetically sealed refrigeration compressor using the exhaust muffler device 8. The compressor housing 26 includes a compressor cylinder block 14, a crankshaft piston connecting rod assembly 21, a valve assembly 22, an intake muffler chamber assembly 23, an electric motor 24, and the exhaust muffler device 8. The electric motor 24 is located on the bottom inside the compressor housing 26. The compressor cylinder block 14 is located above the electric motor 24. The crankshaft piston connecting rod assembly 21 connects to the valve assembly 22 via the compressor cylinder block 14. The compressor cylinder cover 20 is disposed on an end of the valve assembly 22. The intake muffler chamber assembly 23 and the valve assembly 22 are disposed adjacent with each other and are inside the compressor housing 26. The exhaust muffler device 8 is located outside the compressor cylinder block 14 and is separated from the compressor cylinder block 14. A non-metallic shell such as, for example, the shell 12 in FIG. 6, is mounted at the outside of the metal cavity body of the exhaust muffler device 8.

A gas intake pipe extends through the gas intake pipe installation hole on the exhaust muffler device 8. The gas intake pipe connects to the compressor cylinder cover 20 via a gas intake connection pipe 19. The exhaust pipe 15 extends through an exhaust pipe installation hole on the exhaust muffler device 8 and connects to an internal high-pressure exhaust pipe 16 inside the compressor housing 26.

The exhaust muffler device 8 is mounted vertically inside the compressor housing 26.

As shown in FIG. 14, the exhaust muffler device 8 is vertically disposed, and the gas flow into and out of the exhaust muffler device 8 is also in the same vertical direction. In the embodiment shown in FIGS. 6 and 13, the baffle 13 is mounted horizontally inside the metal cavity body between the upper cavity body 9 and the lower cavity body 10. It is to be understood that the exhaust muffler device 8 may be mounted horizontally or vertically, and the exhaust gas may flow horizontally. It is also to be understood that various connection methods can be envisioned and will not be described in detail.

Figure 15:
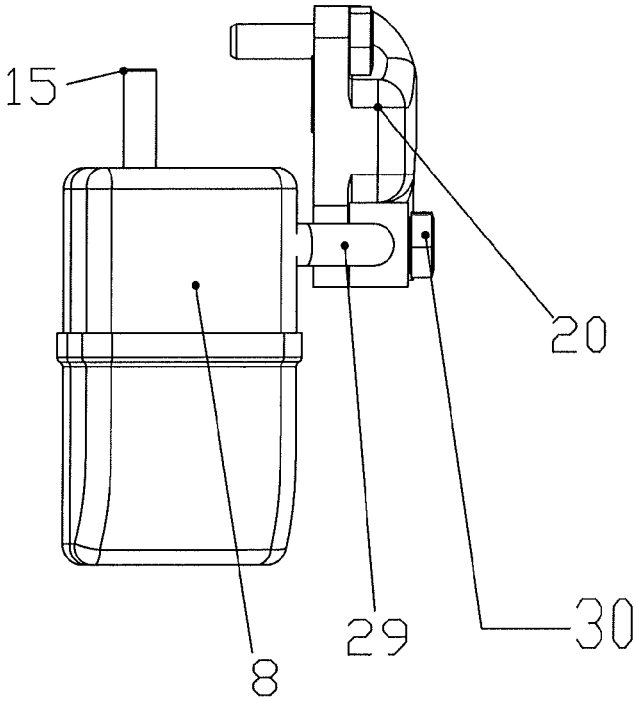
FIG. 15 is a front view of a connection between a gas intake hole of an exhaust muffler device and a compressor cylinder block, according to one embodiment.
Figure 16:
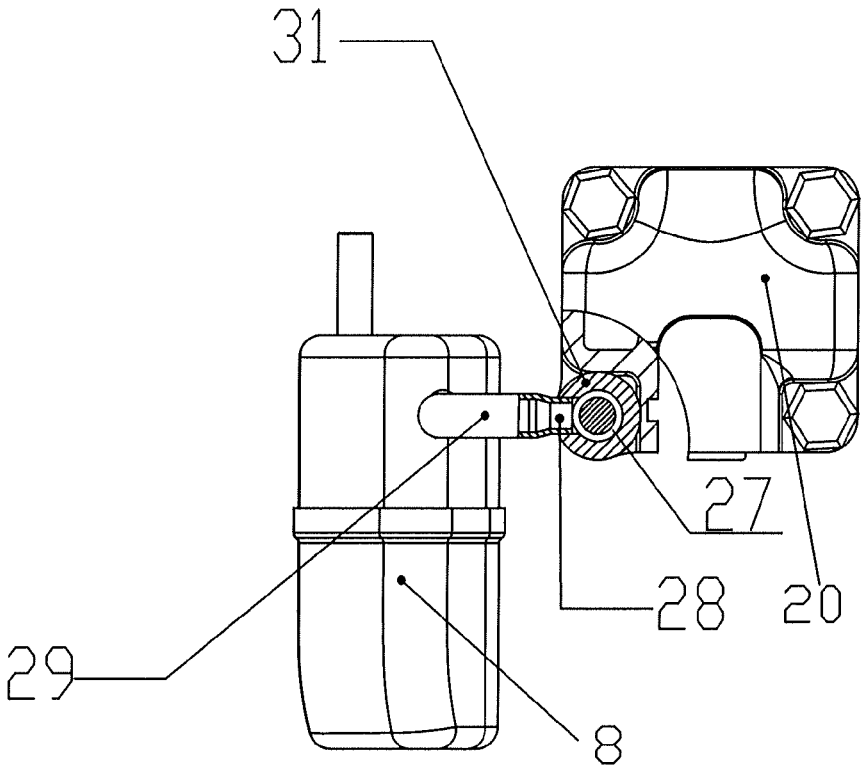
FIG. 16 is a left side perspective view of the connection in FIG. 15.
Figure 17:
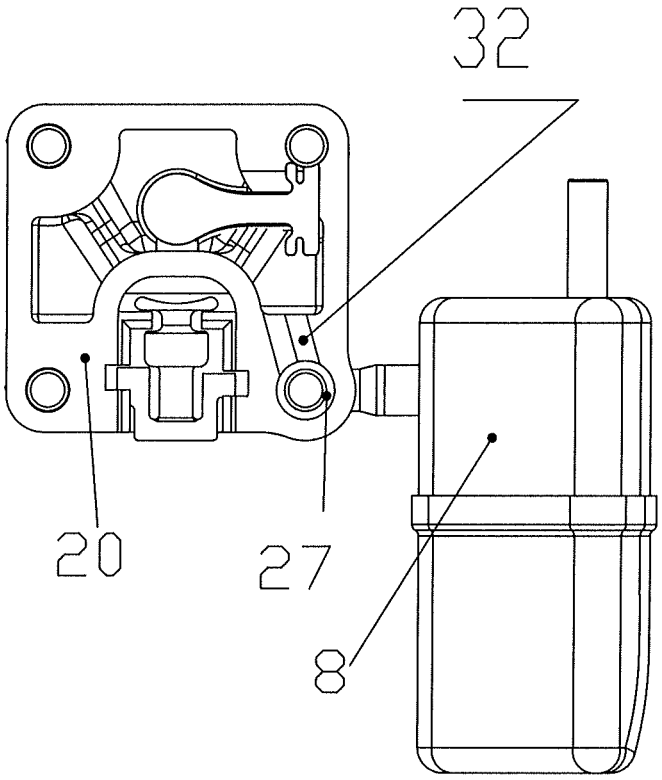
FIG. 17 is a right side perspective view of the connection in FIG. 15.

Further, inside the compressor housing 26, a gas intake pipe and an exhaust pipe can be connected to the exhaust muffler device 8 using conventional butt joints or using the connection configuration shown in FIGS. 15-17. As shown in FIGS. 15-17, a gas intake connection pipe 29 is oriented horizontally. One end of the gas intake connection pipe 29 is connected to a gas intake pipe on the exhaust muffler device 8, and the other end is welded to an annular exhaust connection ring 31 on the compressor cylinder cover 20. A circular gas flow passage 27 is defined in the center of the annular exhaust connection ring 31 and is in fluid communication with a gas flow passage 28 of the gas intake connection pipe 29. Gas can flow through the circular gas flow passage 27 smoothly after installation of a compressor cylinder cover screw 30 thereon. The circular gas flow passage 27 of the annular exhaust connection ring 31 is in fluid communication with a gas flow passage 32 on the compressor cylinder cover 20.

In the embodiments described herein, the non-metallic shell 12 made of a non-metallic material is mounted on the outside of the metal cavity body of the exhaust muffler device 8. The non-metallic material possesses superior heat insulating properties, thereby can significantly reduce heat transfer from the exhaust gas to the inside of the compressor. The raised projections 25 located on the interior walls of non-metallic shell 12 can prevent the contact between the metal cavity body and the non-metallic shell 12 and reduce heat transfer from the metal cavity body to the non-metallic shell 12. As a result, heat transfer from high-temperature-high-pressure gas produced by the compressor cylinder to the refrigerant inside the compressor housing can be reduced. The exhaust muffler device 8 is disposed outside of the compressor cylinder block 14. This can greatly reduce heat transfer during operation of the compressor since heat transfer between the compressor cylinder block 14 and the exhaust muffler device 8 is reduced. Hot compressed gas exiting the compressor cylinder flows through the exhaust pipe 15 and the internal high pressure exhaust pipe 16 and is effectively expelled to the outside of the compressor. Negative impact of hot gas on the compressor can be reduced and cooling performance of the compressor can be significantly improved. The exhaust muffler device of the present disclosure is suitable for use with a hermetically sealed refrigeration compressor, particularly a small-sized hermetically sealed refrigeration compressor.

The above disclosure is only intended to illustrate the preferred embodiments of the present invention and is not intended to limit the scope of the present invention. Therefore any equivalent changes made based on the disclosure of the present invention, such as improvements on the process parameters or the apparatus, are still within the protective scope of the present invention.

The invention claimed is:

1. An exhaust muffler device for a refrigeration compressor, comprising:

a metal cavity body defining an inner cavity;

installation holes on the metal cavity body configured to respectively connect a gas intake pipe and an exhaust pipe to the inner cavity; and a non-metallic shell disposed on an outside of the metal cavity body, wherein the non-metallic shell has installation holes associated with the respective installation holes of the metal cavity body for connecting the gas intake pipe and the exhaust pipe, the non-metallic shell includes first and second shell bodies, each of the shell bodies is separately formed and subsequently joined together to form the non-metallic shell, and the non-metallic shell includes raised projections disposed on an interior wall of a major surface of each of the first and second shell bodies.

2. The exhaust muffler device of claim 1, wherein the non-metallic shell is casted with the metal cavity body to form a single unit, or is chemically deposited on an outer surface of the metal cavity body by electroplating or electrophoresis.

3. The exhaust muffler device of claim 1, wherein the non-metallic shell is made of a non-metallic heat-insulating material that is intermiscible with refrigerant or engine oil for the refrigeration compressor, and the non-metallic heat-insulating material includes a plastic or a rubber.

4. The exhaust muffler device of claim 1, wherein the first and second shell bodies of the non-metallic shell are joined together by snap-fitting, adhesive bonding, or heat bonding.

5. The exhaust muffler device of claim 1, wherein the first shell body of the non-metallic shell has a level bottom and vertical side walls extending perpendicularly from a periphery of the level bottom, the side walls of the first shell body have an equal height; and the second shell body of the non-metallic shell has a slanted bottom and side walls extending from a periphery of the slanted bottom, the side walls of the second shell body extend in parallel to each other toward ends in flush with each other that mate with the sidewalls of the first shell body.

6. The exhaust muffler device of claim 5, wherein one of the first shell body or the second shell body has one or more snap-fitting rings on the side walls along two long sides thereof configured to snap-fitted with one or more protrusions of the other one of the first shell body or the second shell body.

7. The exhaust muffler device of claim 1, wherein the non-metallic shell is made from a PBT engineering plastic.

8. The exhaust muffler device of claim 7, wherein the non-metallic shell has a thickness of 0.5 mm-2.5 mm, the raised projections are projected from the interior wall to a distance of 0.2 mm to 1 mm.

9. The exhaust muffler device of claim 1, wherein the metal cavity body is formed by welding together first and second cavity bodies to define the cavity.

10. The exhaust muffler device of claim 9, further comprising:

a baffle;

wherein the baffle is mounted inside the metal cavity body between the first and second cavity bodies, the baffle has a gas flow buffer hole and an exhaust pipe installation hole, the gas flow buffer hole has a diameter smaller than that of the exhaust pipe installation hole.

11. The exhaust muffler device of claim 10, wherein the baffle is mounted vertically or horizontally inside the metal cavity body between the first and second cavity bodies.

12. The exhaust muffler device of claim 11, wherein the metal cavity body has a rectangular shape, and the non-metallic shell has a shape matching that of the metal cavity body.

13. The exhaust muffler device of claim 1, wherein the exhaust muffler device is located outside of a compressor cylinder block of the refrigeration compressor, and is separated from the compressor cylinder block.

14. A hermetically sealed refrigeration compressor including the exhaust muffler device of claim 1, comprising:

a compressor housing; and a compressor cylinder block;

a crankshaft piston connecting rod assembly;

a valve assembly;

an intake muffler chamber assembly;

an electric motor; and the exhaust muffler device disposed inside the compressor housing, wherein the electric motor is located on a bottom inside the compressor housing, the compressor cylinder block is located above the electric motor, the crankshaft piston connecting rod assembly connects to the valve assembly through the compressor cylinder block, the compressor cylinder cover is located at an end of the valve assembly, the intake muffler chamber assembly and the valve assembly are disposed adjacent with each other inside the compressor housing, and wherein the exhaust muffler device is located outside the compressor cylinder block and is separated from the compressor cylinder block.

15. The refrigeration compressor of claim 14, wherein a gas intake pipe extends through a gas intake pipe installation hole on the exhaust muffler device, the gas intake pipe connects to the compressor cylinder cover via a gas intake connection pipe, an exhaust pipe extends through an exhaust pipe installation hole on the exhaust muffler device, and the exhaust pipe is in fluid communication with the outside of the compressor housing via an internal high pressure exhaust pipe.

16. The refrigeration compressor of claim 15, wherein the exhaust muffler device is mounted vertically or horizontally inside the compressor housing.

17. The refrigeration compressor of claim 16, wherein inside the compressor housing, the gas intake connection pipe between the gas intake pipe of the exhaust muffler device and the compressor cylinder cover is horizontally disposed, a first end of the gas intake connection pipe connects to the gas intake pipe of the exhaust muffler chamber, a second end of the gas intake connection pipe is welded to an annular exhaust connection ring on the compressor cylinder cover, a circular gas flow passage in the center of the annular exhaust connection ring is in fluid communication with a gas flow passage of the gas intake connection pipe, the circular gas flow passage allows gas to flow therethrough after installation of a compressor cylinder cover screw thereon, and the circular gas flow passage in the annular exhaust connection ring is in fluid communication with a gas flow passage of the compressor cylinder cover.

* * * * *